US006830514B2

(12) United States Patent
Meyer et al.

(10) Patent No.: US 6,830,514 B2
(45) Date of Patent: Dec. 14, 2004

(54) SYSTEM AND METHOD FOR PLAYING A LOTTERY-TYPE GAME

(75) Inventors: Mark G. Meyer, Zionsville, IN (US); Joseph J. Tracy, Westminster, MD (US); Fred L. Richard, Olympia, WA (US); Deborah Jonasson, Carmel, IN (US); Keith A. Jonasson, Carmel, IN (US)

(73) Assignee: Scientific Games Royalty Corporation, Newark, DE (US)

( * ) Notice: Subject to any disclaimer, the term of this patent is extended or adjusted under 35 U.S.C. 154(b) by 122 days.

(21) Appl. No.: 10/020,866

(22) Filed: Dec. 13, 2001

(65) Prior Publication Data

US 2003/0114210 A1 Jun. 19, 2003

(51) Int. Cl.[7] ..... A63F 3/06

(52) U.S. Cl. ..... 463/17; 463/16; 273/269; 273/139

(58) Field of Search ..... 463/16, 17, 18, 463/19; 273/269, 139

(56) References Cited

U.S. PATENT DOCUMENTS

| | | | | |
|---|---|---|---|---|
| 5,112,050 A | | 5/1992 | Koza et al. | 273/139 |
| 5,116,049 A | | 5/1992 | Sludikoff et al. | 273/139 |
| 5,186,463 A | * | 2/1993 | Marin et al. | 463/27 |
| 5,232,221 A | | 8/1993 | Sludikoff et al. | 273/139 |
| 5,249,801 A | * | 10/1993 | Jarvis | 273/148 R |
| 5,273,281 A | | 12/1993 | Lovell | 273/138 |
| 5,380,007 A | | 1/1995 | Travis et al. | 273/138 |
| 5,393,057 A | | 2/1995 | Marnell, II | 273/85 |
| 5,401,024 A | | 3/1995 | Simunek | 273/138 |
| 5,451,052 A | | 9/1995 | Behm et al. | 273/139 |
| 5,564,700 A | | 10/1996 | Celona | 463/27 |
| 5,770,533 A | | 6/1998 | Franchi | 463/42 |
| 5,772,509 A | | 6/1998 | Weiss | 463/16 |
| RE35,864 E | | 7/1998 | Weingardt | 463/28 |
| 5,830,063 A | | 11/1998 | Byrne | 463/18 |
| 5,833,537 A | | 11/1998 | Barrie | 463/21 |
| 5,979,894 A | * | 11/1999 | Alexoff | 273/139 |
| 5,996,997 A | | 12/1999 | Kamille | 273/139 |
| 6,024,641 A | * | 2/2000 | Sarno | 463/17 |

(List continued on next page.)

FOREIGN PATENT DOCUMENTS

| | | |
|---|---|---|
| WO | WO 00/78418 | 12/2000 |
| WO | WO 01/93966 | 12/2001 |

OTHER PUBLICATIONS

Application Ser. No.:09/590,735 filed Jun. 8, 2000, Title: "System and Method for Playing a Multiplier Game", 28 pages.*

Oregon Lottery, How to Play Megabucks, May 8, 2001.

Oregon Lottery, How to Play Megabucks, Mar. 9, 2001.

Maryland Launches Let It Ride®, Circa 2001.

*Primary Examiner*—Jessica J. Harrison

(74) *Attorney, Agent, or Firm*—Arnall Golden Gregory LLP

(57) ABSTRACT

A system and method of playing a lottery-type game are provided. The game comprises obtaining at least one player-selected combination, or concatenated indicia string, such as from a series of one or more columns on a game play slip. A first random combination, or concatenated indicia string, is generated by a gaming administrator and it is determined whether at least one of the player-selected combinations matches the gaming administrator generated combination. Regardless of whether any player-selected combinations match the first gaming administrator generated combination, at least a second gaming administrator generated combination, or more, may be provided for a player to determine whether at least one of the player-selected combinations matches the second gaming administrator generated combination. A payout amount may be awarded based upon the number of player-selected combinations and gaming administrator generated combinations matched.

28 Claims, 5 Drawing Sheets

U.S. PATENT DOCUMENTS 6,077,162 A 6/2000 Weiss ..... 463/26
6,102,400 A * 8/2000 Scott et al. ..... 273/269
6,142,872 A 11/2000 Walker et al. ..... 463/16
6,179,710 B1 1/2001 Sawyer et al. ..... 463/16
6,217,448 B1 4/2001 Olsen ..... 463/25
6,227,969 B1 5/2001 Yoseloff ..... 463/13
6,315,291 B1 * 11/2001 Moody ..... 273/139
6,599,186 B1 * 7/2003 Walker et al. ..... 463/17

* cited by examiner

| PRIZE AMOUNTS AND PAYOUT PERCENTAGE | | | | | | | |
|---|---|---|---|---|---|---|---|
| Spots Played | 0 Wins | 1 Win | 2 Wins | 3 Wins | 4 Wins | 5 Wins | Total Percent of Sales Paid Out |
| 2 | $0.00 | $50.00 | $1,000.00 | $100,000.00 | $1,000,000.00 | $20,000,000.00 | 61.73% |
| 3 | $0.00 | $10.00 | $100.00 | $2,500.00 | $200,000.00 | $10,000,000.00 | 60.16% |
| 4 | $0.00 | $5.00 | $20.00 | $200.00 | $5,000.00 | $500,000.00 | 65.77% |
| 5 | $0.00 | $0.00 | $10.00 | $50.00 | $500.00 | $25,000.00 | 61.83% |

FIG. 5

| ADJUSTED PRIZE LIABILITY BY DRAW: CUMULATIVE WINNINGS | | | | | | |
|---|---|---|---|---|---|---|
| Spots Played | 0 Win(s) | 1st Win | 2nd Win | 3rd Win | 4th Win | 5th Win |
| 2 | $0.00 | $50.00 | $950.00 | $99,000.00 | $900,000.00 | $19,000,000.00 |
| 3 | $0.00 | $10.00 | $90.00 | $2,400.00 | $197,500.00 | $9,800,000.00 |
| 4 | $0.00 | $5.00 | $15.00 | $180.00 | $4,800.00 | $450,000.00 |
| 5 | $0.00 | $0.00 | $10.00 | $40.00 | $450.00 | $24,500.00 |

FIG. 6

SYSTEM AND METHOD FOR PLAYING A LOTTERY-TYPE GAME

BACKGROUND OF THE INVENTION

1. Field of the Invention

The present invention relates generally to games of chance, and more particularly, to a system and method for playing a game of chance, such as, for example, as lottery-type game, wherein players are afforded multiple opportunities to achieve a winning outcome.

2. State of the Art

Various conventional lottery-type games allow a player to select one or more groups of numbers to match with a group of numbers generated by a gaming administrator, which may include, for example, a gaming administrator, gaming authority or some other gaming operator. For example, gaming administrators offer lottery-type games, sometimes referred to as "Pick-3," in which a player selects three numbers to match identically with a set of three numbers generated by the gaming administrator.

Often, gaming administrators require the player not only to match the numbers, but also to match the order in which the numbers are generated. With reference to the previous example, if a player were to select the number group "123" and the numbers generated by the gaming administrator were "213", the play would not be considered a winning outcome even though the player had correctly matched the three numbers because the order of the concatenated string of numbers was not matched.

Generally, a gaming administrator must balance the size of the payout for a winning play with the quantity of numbers the player must match to produce a winning outcome. For example, if the gaming administrator offers a high payout, it generally requires the player to match 6 or 7 numbers. However, this type of lottery game typically produces very few winners and often causes players to lose interest in the game.

In another example, if the gaming administrator wishes to produce winners more frequently, it may reduce the quantity of numbers a player must match in order to enjoy a winning outcome. For instance, a match of 3 or 4 numbers could result in a winning outcome. However, gaming administrators often reduce the amount of the payout for a winning play in a game of this nature. Accordingly, this type of lottery game also quickly can cause players to lose interest in the game.

To overcome these weaknesses of the prior art, lottery-type games have been developed which seek to increase user interest by requiring fewer numbers to be matched and by providing the player an opportunity to win larger payout amounts for winning plays. One such game is disclosed in U.S. patent application Ser. No. 09/590,735 entitled SYSTEM AND METHOD FOR PLAYING A MULTIPLIER GAME and assigned to the assignee hereof. application Ser. No. 09/590,735 discloses a system and method for playing a multiplier game in which a player purchases a ticket for a minimum wager amount set by the gaming administrator to become eligible to participate in a given draw. If the ticket loses in the draw, the result is a non-winning play and the ticket is no longer active. However, if the ticket wins in the draw, the player has the option to collect his/her winnings and inactivate the ticket, or parlay the winnings for a chance to win a significantly larger prize amount in a second, subsequent draw. If the ticket loses in the second draw, the previously won prize amount is forfeited, the ticket is inactivated, and the game is over. However, if the ticket wins in the second draw, the player either may collect the increased prize amount, or parlay the winnings to a third, subsequent draw for a chance to win an even larger prize amount. This process continues for a variable number of draws prescribed either by the gaming administrator or by player selection. Thus, for a single wager amount, players may participate in multiple draws, so long as the player achieves a winning play in each draw played.

The game of application Ser. No. 09/590,735 also permits players to chose the odds of winning and the size of prizes for which they wish to play by choosing the quantity of indicia they want to cover in each of a plurality of columns on the associated game play slip. The more indicia selected, the better the odds of winning and the smaller the prizes which may be won. Conversely, fewer numbers selected results in less favorable odds and larger potential prizes. These dynamics provide lottery game participants a level of control previously available only in other gaming venues.

While addressing many drawbacks of the prior art, the game disclosed by application Ser. No. 09/509,735 may be perceived as being too complex to the more inexperienced gambler. For instance, a relatively high number of decisions are required by the player for play eligibility, which can be intimidating to those unfamiliar with the concept of gambling odds. Further, less experienced gamblers often are hesitant to forfeit what they have already won and, thus, they will not choose to parlay their winnings in most instances. As such, they participate in only one draw, making the game more like traditional lottery-type games and taking on many of the drawbacks associated with such games as mentioned above.

Accordingly, there is a need in the gaming industry for a lottery-type game which is relatively simple and allows players of all experience levels to participate. It would be desirable to configure such a game such that few decisions are required by the player while still enabling the player to have some control over his or her odds of winning and the size of potential payout amounts. In implementing such a game it may be desirable to allow players to place a relatively small initial wager for which they are permitted to participate in multiple draws without having to forfeit prizes won in order to continue their eligibility for play.

BRIEF SUMMARY OF THE INVENTION

In accordance with one aspect of the present invention, a method of playing a lottery game is provided. The method includes obtaining at least one player-selected combination of indicia and obtaining a first randomly generated combination of indicia. The two combinations are compared to determine whether a match has occurred. A second randomly generated combination of indicia is obtained and then compared again with the player-selected combination of indicia to determine whether a match has occurred, regardless of whether the first randomly generated combination of indicia and player-selected combination of indicia resulted in a match. Additional randomly produced combinations of indicia may be generated for subsequent comparison regardless of the success of the previous comparisons.

In accordance with another aspect of the present invention a method of conducting a lottery game is provided. The method includes providing a plurality of player selectable indicia and allowing a player to select at least one combination of indicia from the plurality. A first randomly generated combination of indicia is produced from a set of indicia which corresponds with the plurality of selectable indicia. The player-selected combination of indicia and randomly generated combination of indicia are compared to determine whether a match has occurred. A second randomly generated combination of indicia is produced from the set of indicia and is compared with the player-selected combination of indicia to determine whether a match has occurred regardless of the comparison of the first randomly generated combination of indicia with the player-selected combination of indicia.

In accordance with another aspect of the invention, another method of conducting a lottery game is provided. The method includes requiring a player to become eligible for a plurality of rounds of play. The player is provided with an opportunity to win in each round of play in which the player is eligible. A nonlinear payout schedule is provided for awarding multiple winning rounds of play within the plurality of rounds of play in which the player is eligible.

In accordance with another aspect of the invention, a system is provided for facilitating a lottery game. The system includes at least one indicia generator configured to sequentially generate a plurality of combinations of indicia. A set of player selectable indicia is provided and a selecting device allows a player to select a specified quantity of indicia from the set of player selectable indicia to create a player-selected combination of indicia. A processor is configured to determine the number of matches, if any, between the player-selected combination of indicia and a set quantity of the plurality of sequentially generated combinations of indicia.

BRIEF DESCRIPTION OF THE SEVERAL VIEWS OF THE DRAWINGS

In the accompanying drawings which form a part of the specification and are to be read in conjunction therewith, and in which like reference numerals are employed to indicate like parts in the various figures:

FIG. 5 is a table diagram illustrating a sample prize structure which may be used in accordance with an embodiment of the present invention;

FIG. 6 is a table diagram illustrating a sample adjusted prize liability table which may be used in accordance with the sample prize structure illustrated in FIG. 5;

DETAILED DESCRIPTION OF THE INVENTION

Figure 1:
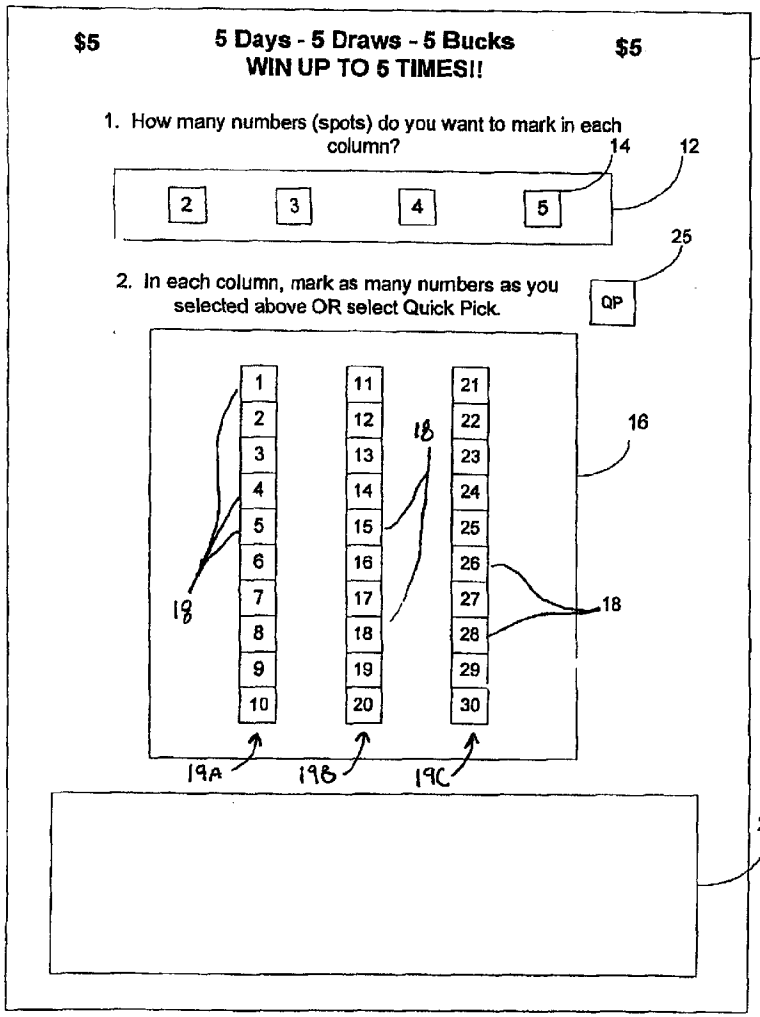
FIG. 1 illustrates a game play slip for obtaining player selection for a lottery-type game in accordance with an embodiment of the present invention.
Figure 2:
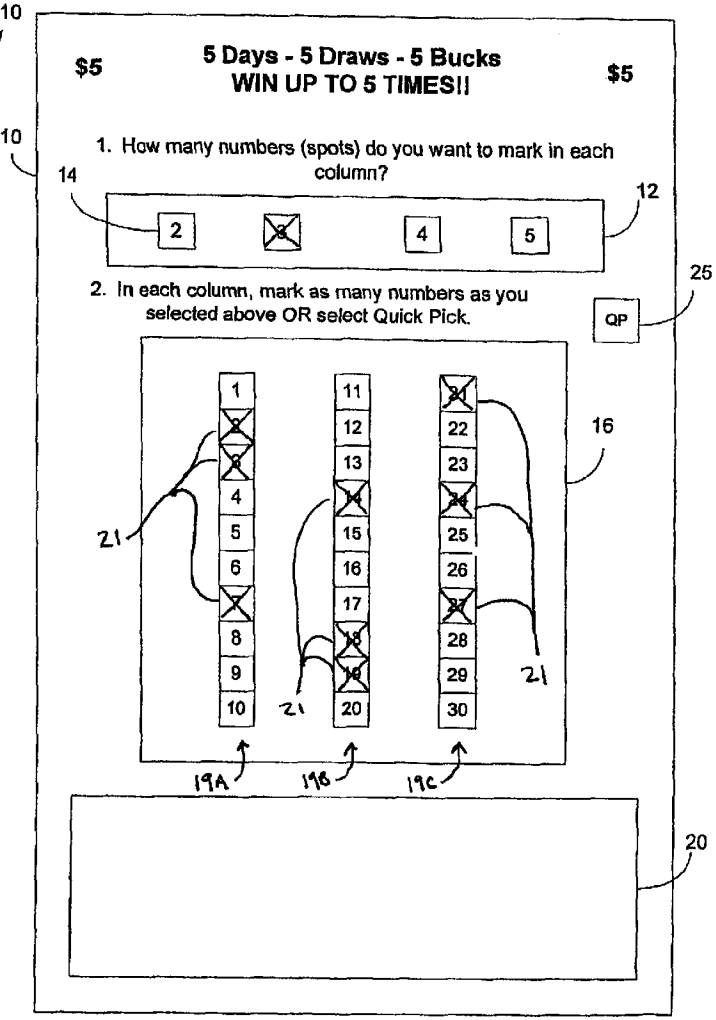
FIG. 2 illustrates the game play slip of FIG. 1 as utilized by a player.

Referring now to the drawings, and initially to FIGS. 1 and 2, an exemplary game play slip 10 which may be used in accordance with an exemplary embodiment of the lottery-type game of the present invention is illustrated. FIG. 1 depicts the game play slip 10 prior to player input or selection while FIG. 2 shows an enabled play slip indicating a player's selection as shall become more apparent with the description below.

The game play slip 10 contains a plurality of fields which must be completed for the slip holder to be eligible for play including, for example, a player indicia determining field 12 and a playing field, also referred to herein as the matrix 16 which contains a set of individual player selectable indicia 18. The player indicia determining field 12 contains a set of numbered indicia 14 which allows a player to indicate the quantity of selectable indicia 18, also referred to herein as spots, which are to be selected by the player in each column 19A–19C of the matrix 16. As will become apparent from the description below, the higher the quantity of spots 18 chosen in player indicia determining field 12, the greater the odds of achieving a winning outcome in each draw or round of play and, accordingly, the lower the potential payout amount associated with such winning outcomes. Conversely, the lower the quantity of spots chosen in the player indicia determining field 12, the lower the odds of achieving a winning outcome in each draw and the higher the potential payout amount associated therewith.

The playing field or matrix 16 must also be completed for the game play slip holder to achieve eligibility for play. Within the matrix 16 is at least one column 19 with each column 19 including a plurality of selectable indicia 18 which may include numbers, letters or other symbols. The collection of indicia in the matrix 16 makes up a set of indicia from which a subset of player-selected indicia 21 and gaming administrator generated indicia will be chosen, as more fully described below. In the particular example depicted in FIGS. 1 and 2, the matrix 16 contains three columns 19A–19C. Within each column is a set of selectable indicia or spots 18. For example, the first column 19A may include spots 18 represented by numbers ranging from 1–10, the second column 19B may include spots 18 represented by numbers ranging from 11–20, and the third column 19C include spots 18 represented by numbers ranging from 21–30. Such an arrangement of three columns 19A–19C each containing ten indicia may be referred to as a "3×10" grid or matrix. It will be understood by those of ordinary skill in the art that the matrix may be organized as having a plurality of rows, each including a plurality of player selectable indicia 18, rather than in columns if so desired. Additionally, while the columns 19A–19C of the matrix 16 shown in FIGS. 1 and 2 each include an equal number of spots 18 therein, each column 19A–19C, if so desired, may include a different number of spots 18 than other columns 19A–19C within the matrix 16.

As shown in FIGS. 1 and 2, the game play slip 10 may also include a payout table 20. While the contents of the payout table 20 are not shown in FIG. 1 or 2, the payout table 20 desirably illustrates the potential payout for a given number of winning draws based upon the number of spots 18 selected in each column 19A–19C as determined by the numbered indicia 14 selected in the player indicia determining field 12. The payout table 20 printed on the game play slip 10 may vary based upon the selection made within the player indicia determining field 12 and, if desired, upon the amount wagered as well. However, in the exemplary embodiment, each player wagers the same amount of money to play in the same number of consecutive draws and, thus, only one payout table illustrating payout amounts based upon a number of winning draws and an amount of spots selected need be shown. An exemplary payout table is illustrated in FIG. 6 and will be discussed in greater detail below.

It will be understood and appreciated by those of skill in the art that the number of columns 19 as well as the range of selected indicia 18 within each column 19 may vary and such variations are contemplated to be within the scope of the present invention. For instance, rather than the indicia in each column being a series of consecutive numbers, each column may contain identical numbers (e.g., 1–10). In another example, there may be a quantity of columns other than three. In yet a further example, the columns may each contain a quantity of indicia other than 10. Additionally, while it may be desirable in many instances to maintain an equal quantity of selectable indicia 18 in each column, the quantities of selectable indicia or spots 18 may be varied from one column to another, if so desired.

In the exemplary embodiment shown in FIGS. 1 and 2, the player indicia determining field 12 and the matrix 16 are the only two fields which must be completed for the holder of the game play slip 10 to be eligible for play. It will be understood and appreciated, however, by those of skill in the art that additional fields may be added as desired. For instance, the player may be allowed to determine a wager amount, select a variable number of draws in which to participate, or select play eligibility in non-consecutive draws.

Conversely, it may be desirable in certain instances to provide fewer player input fields. For example, the player determining indicia field 12 may be removed from the game slip 10 such that the quantity of spots 18 that may be selected in each column 19A–19C by a player is predetermined. In such an embodiment, the only player input field remaining would be the matrix 16. Thus, such an embodiment, while removing control of the odds from the player, would provide a more simple game requiring only a single player decision.

Each of the above fields may be modeled or tailored to obtain desired payout structures, number of winners, and game outcomes. Optional game features include "insurance," "early cash-out," and "rolling cash-pots". It is to be understood that a lottery-type game containing any or all of these features is contemplated to be within the scope of the present invention as will be understood and appreciated by one of ordinary skill in the art.

It is to be understood that the game play slip 10 depicted in FIG. 1 is provided for illustrative purposes only, and that the game of the present invention need not be played using any particular device. The present invention instead may be carried out by any suitable electronic, mechanical, or manual device which suitably collects the necessary information, as would be evident by a reading of the following description. As such, the game play slip 10 shown and described does not in any way limit the scope of the present invention, but merely represents one exemplary mode for carrying out the invention.

Figure 3:
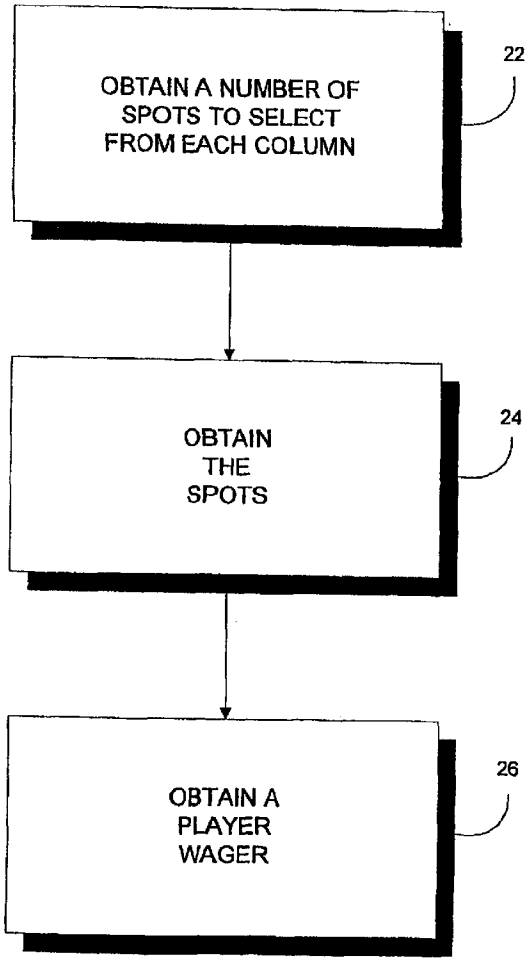
FIG. 3 is a flow diagram of an embodiment establishing a lottery-type game in accordance with an embodiment of the present invention.

Turning to FIG. 3, a block diagram of an exemplary method designed to prepare a player for participation in a lottery-type game in accordance with an exemplary embodiment of the present invention is illustrated. A quantity of spots 18 is first obtained or selected as indicated by reference numeral 22 of the illustrated method. The number of spots 18 obtained determines the quantity of spots 18 which may be selected in each column 19A–19C of the matrix 16. In the exemplary embodiment, the player selects the number of spots 16 by choosing one of the numbered indicia 14 listed in the player indicia determining field 12 of the game play slip 10. In the example illustrated in FIG. 2, the numbered indicia 14 in player indicia determining field 12 containing the numeral "3" is marked. This indicates that three selectable indicia or spots 18 will be chosen from each column 19A–19C of the matrix 16. The particular selectable indicia 18 which are chosen by a player become the player-selected indicia 21 as illustrated in FIG. 2.

The numbered indicia 14 selected in player indicia determining field 12, along with the number of columns 19A–19C on the game play slip 10, determines the number of combinations, or concatenated indicia strings, which are possible from the selected indicia 21. For example, in the 3×10 matrix game play slip 10 illustrated in FIGS. 1 and 2, the matrix 16 contains three columns 19A–19C. If two spots 18 are selected in each column 19A–19C, eight different player combinations or concatenated indicia strings are possible. If three spots 18 are selected, as in the example illustrated in FIG. 2, twenty-seven different player combinations are possible. If four spots are selected in each column, eighty-one different player indicia are possible.

As an example of player combinations or concatenated indicia strings, and referring to FIG. 2, the first column 19A includes player-selected indicia 21 of "2," "3" and "7;" the second column 19B includes player-selected indicia 21 of "14," "18" and "19;" and the third column 19C includes player-selected indicia 21 of "21," "24" and "27." Thus, one player combination or concatenated indicia string shown on the play slip 10 of FIG. 2 is "2-14-21," another is "2-14-24" and so on, including an additional twenty-five player combinations for a total of twenty-seven player combinations.

Further, the correlation between the number player-selected indicia 21 in each column 19A–19C and the total number of player-selected combinations is represented by the formula $X^n$, wherein "X" represents the numbered indicia 14 selected in player indicia determining field 12 and "n" represents the number of columns 19A–19C present in the matrix 16.

Further, if "Y" represents the total number of spots 18 in each column 19A–19C and, again, "n" represents the number of columns 19A–19C present in matrix 16, then $Y^n$ equals the total number of possible combinations represented by the matrix 16. Consequently, the odds of winning a single draw are represented by $X^n$ divided by $Y^n$. Thus, in the example illustrated in FIG. 2, the odds of a player winning are 27 out of 1,000 (i.e., $3^3/10^3=27/1000$).

This dynamic relationship permits players to select or control the odds of winning as well as the associated amount of the potential payout within the parameters set forth by the gaming administrator. If a player chooses to select more spots 18 in each column 19A–19C, the odds of winning increase and the potential payout amounts for winning plays decrease. Conversely, if fewer spots are selected in each column 19A–19C, the odds of winning decrease and the potential payout amounts for winning plays increase.

Referring back to the method illustrated in FIG. 3 after determining the quantity of spots 18 to select from each column 19A–19C the player-selected indicia 21 are obtained or determined as indicated at 24. Thus, the player selects the proper quantity of player-selected indicia 21 from each column 19A–19C of the matrix 16 according to the numbered indicia 14 previously selected and marked in the player indicia determining field 12. As an alternative to choosing the appropriate quantity of indicia from each column, the player may select box 25 and obtain spots generated by the gaming administrator. Such a selection may be referred to in the art as a "Quick Pick." The "player-selected indicia" selected by the operator or authority on behalf of the game slip holder may either be manually selected or machine generated.

Each player may choose any of the spots 18 among the plurality in each column 19A–19C. Although a player may select spots 18 corresponding to the same positions in each column 19A–19C, the player-selected indicia 21 marked in one column need not match the player-selected indicia 21 marked in any other column such as is indicated in the game play slip 10 illustrated in FIG. 2. Any and all combinations of player-selected indicia 21 are contemplated to be within the scope of the present invention so long as the number of spots 18 marked in each column 19A–19C corresponds to the number 14 chosen in player indicia determining field 12.

Referring still to FIG. 3, after the player-selected indicia 21 (FIG. 2) has been obtained 24, a wager is obtained as indicated at 26. In the exemplary embodiment, the wager made by each player for play in the game is identical. For example, in the game play slip illustrated in FIGS. 1 and 2, each player may be required to wager $5.00 to play the game. Such a required wager may be used to maintain the eligibility of the player of the game play slip for five draws. As such, the wager is $1.00 per draw, which is a well established pricing structure throughout the lottery gaming industry. Of course, other wager amounts per draw may be used as desired.

The ability, or requirement, if so set by the gaming administrator, of purchasing and playing multiple draws with a single game play slip 10 is an additional feature of the lottery-type game of the present invention. It is noted that a single draw or round of play is associated with one set of gaming administrator generated indicia resulting in a gaming administrator generated combination of indicia or concatenated indicia string. Prior to beginning the lottery game of the present invention, the number of draws for which the game play slip 10 will be eligible may be set forth by the gaming administrator.

For example, the game play slip 10 illustrated in FIGS. 1 and 2 is a "5-draw" game slip. As such, the game play slip 10 is eligible for five draws or rounds of play and, thus, the player has five draws in which he or she may compare the player-selected indicia 21 (and the player combinations or concatenated indicia strings resulting therefrom) with the gaming administrator generated combinations. A match between a player combination and a gaming administrator generated combination results in a win for a given draw in which a game play slip 10 is eligible.

While the exemplary embodiment contemplates that a plurality of wins in a multi-draw game need not be consecutive to receive a payout therefrom, such a parameter may be determined by the gaming administrator. Likewise, while the exemplary embodiment contemplates a player participating with a given game play slip 10 in a specified number of consecutive draws, such a parameter may also be determined by the gaming administrator. Thus, it will be understood and appreciated by those of skill in the relevant art that the game play slip 10 also may contain an option wherein the player may select eligibility for draws which are not consecutive. However, the quantity of draws for which the game play slip is eligible (e.g., five in the example of FIG. 1) may be set by the gaming administrator prior to the commencement of play. Further, it will be understood and appreciated that the frequency of draws (e.g., one per day, two per day) may likewise be determined by the gaming administrator as may be desired.

In another embodiment of the present invention, players may be permitted to participate in a variable number of draws, the eligible draw number established at the time the player wager is made (e.g., $2.00 wagered for 2 draws or $4.00 wagered for 4 draws). While such variations are contemplated to be within the scope of the present invention, in the exemplary embodiment such options are not available primarily because allowing players to purchase variable eligible draw tickets adds an extra and unnecessary decision to the purchase process and reduces the ease of obtaining eligibility for play.

In producing the administrator generated indicia for comparison with the player-selected indicia 21, each column in the matrix 16 of game play slip 10 may correspond to a drum (not shown) or some other indicia generator. The drum may contain, for example, one of each indicium represented in the column to which it corresponds. Thus, in the example illustrated in FIGS. 1 and 2, the gaming administrator may have three drums, the first containing numbers 1–10, the second containing the numbers 11–20 and the third containing the numbers 21–30. From each drum, a single winning indicium may be drawn by the gaming administrator. The resulting subset of indicia, represented by one indicium from each drum, makes up the gaming administrator generated combination for a single draw. In other words, the gaming administrator generated combination includes a subset of indicia randomly generated by the gaming administrator and represented by one indicium selected from each column.

It is to be understood that the gaming administrator generated combination may be produced using any suitable electronic, mechanical or manual device, including, for example, a computer controlled random number generator, as will be evident to those of ordinary skill in the art. For example, another embodiment may employ an indicium generator in the form of a conventional blower-type apparatus adapted for use with ping pong balls, on which indicia are printed, for randomly generating the indicia.

It is to be further understood that the gaming administrator may generate multiple combinations in a single round of play if so desired. In other words, using the example given above, a plurality of indicia may be drawn from a single drum corresponding with a given column 19 of indicia 18. Further, if so desired, only a select number of the columns may have multiple indicia drawn from their corresponding drum or indicia generator, while other columns may only have a single indicia drawn during a given round of play. Thus, for example, a drum or indicia generator corresponding with column 19A and including indicia or numbers 1–10 may have two or three indicia drawn therefrom while drums or indicia generators corresponding to columns 19B and 19C may have only a single indicia or number drawn therefrom during a single round of play. If so desired, the decision to draw a plurality of indicia from a given drum or indicia generator may be predetermined and announced before the round of play in which such will occur. Alternatively, such a decision may be at random or may be predetermined but unannounced.

As noted above, a payout table 20 may be included on the game play slip to aid players in deciding the quantity of spots 18 to select from each column 19A–19C. As illustrated in the exemplary payout table of FIG. 5, the more spots 18 selected, the higher the odds of winning and, accordingly, the lower the payout amounts. Conversely, the fewer spots selected, the lower the odds of winning and, accordingly, the higher the payout amounts.

Figure 4:
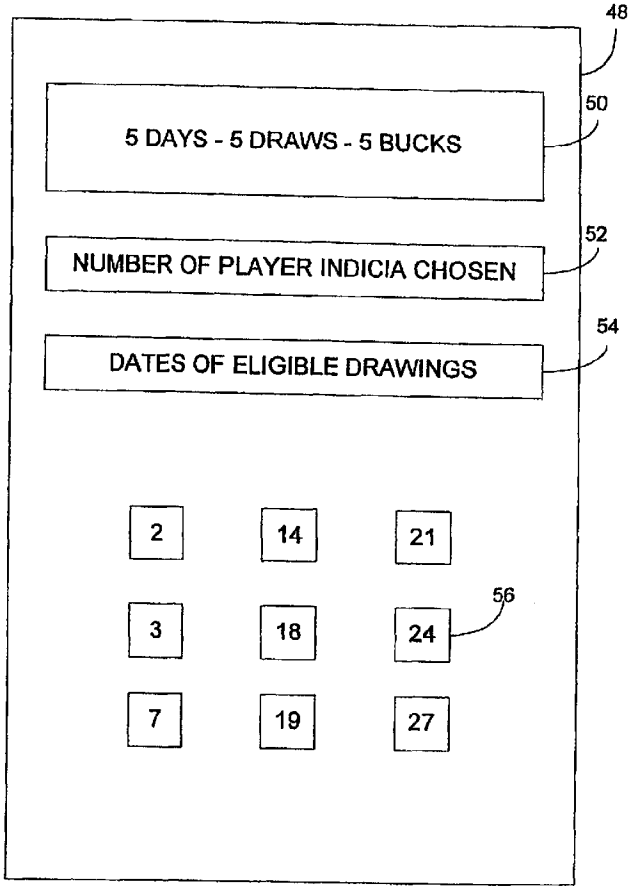
FIG. 4 illustrates a wager ticket generated by a gaming administrator for a lottery-type game in accordance with an embodiment of the present invention.

Once the game play slip 10 is completed and turned in to the gaming administrator, the gaming administrator will process the information contained thereon and generate a wager ticket 48 as illustrated in FIG. 4. At the top of the wager ticket 48 is an indication of the type of game 50 the player has chosen to play. In FIG. 4, the type of game indicated is "5 DAYS-5 DRAWS-5 BUCKS." Such may indicate, for example, that the ticket required an eligibility wager of $5.00 and that the ticket is eligible for five draws which will take place over the course of five days. However, as noted above, any desired draw frequency, associated time period or wager amount may be set forth by the gaming administrator. Below the game type 50 is an indication of the number of spots 18 the player has chosen to play 52. Beneath the spot quantity indication 52 is listed the dates and/or times 54 of the draws for which the ticket holder is eligible to participate. In the exemplary embodiment, there is one draw per day and thus a corresponding range of dates would be shown in the wager ticket 48 of FIG. 4.

The final item shown on wager ticket 48 of FIG. 4 is a listing 56 of the number of player-selected indicia 21 in each column 19A–19C of the game play slip 10. Any combination of indicia indicated, including one from each column 19A–19C, represents an eligible player-selected combination or concatenated indicia string. If any player-selected combination matches the gaming administrator generated combination in a qualifying draw, the draw is a winning draw for the ticket holder. It is noted that the listing 56 of player-selected indicia 21 is shown in FIG. 4 to be arranged in a pattern which corresponds to the matrix 16 of the game play slip 10 from which they were selected. However, if the player selectable indicia 18 includes a plurality of unique indicia, (e.g., non-repeating numbers) the listing 56 of player-selected indicia may be organized in any manner so desired and need not correspond to the matrix 16 of player-selectable indicia 18.

It is to be understood that the wager ticket 48 may include any or all of the above information, as well as any additional information as desired by the gaming administrator. It is to be further understood that the wager ticket 48 is provided for illustrative purposes only, and that the game of the present invention need not be played using any particular device. Rather, the present invention instead may be carried out by any suitable electronic, mechanical or manual device which adequately displays the selections made by the player.

Figure 7:
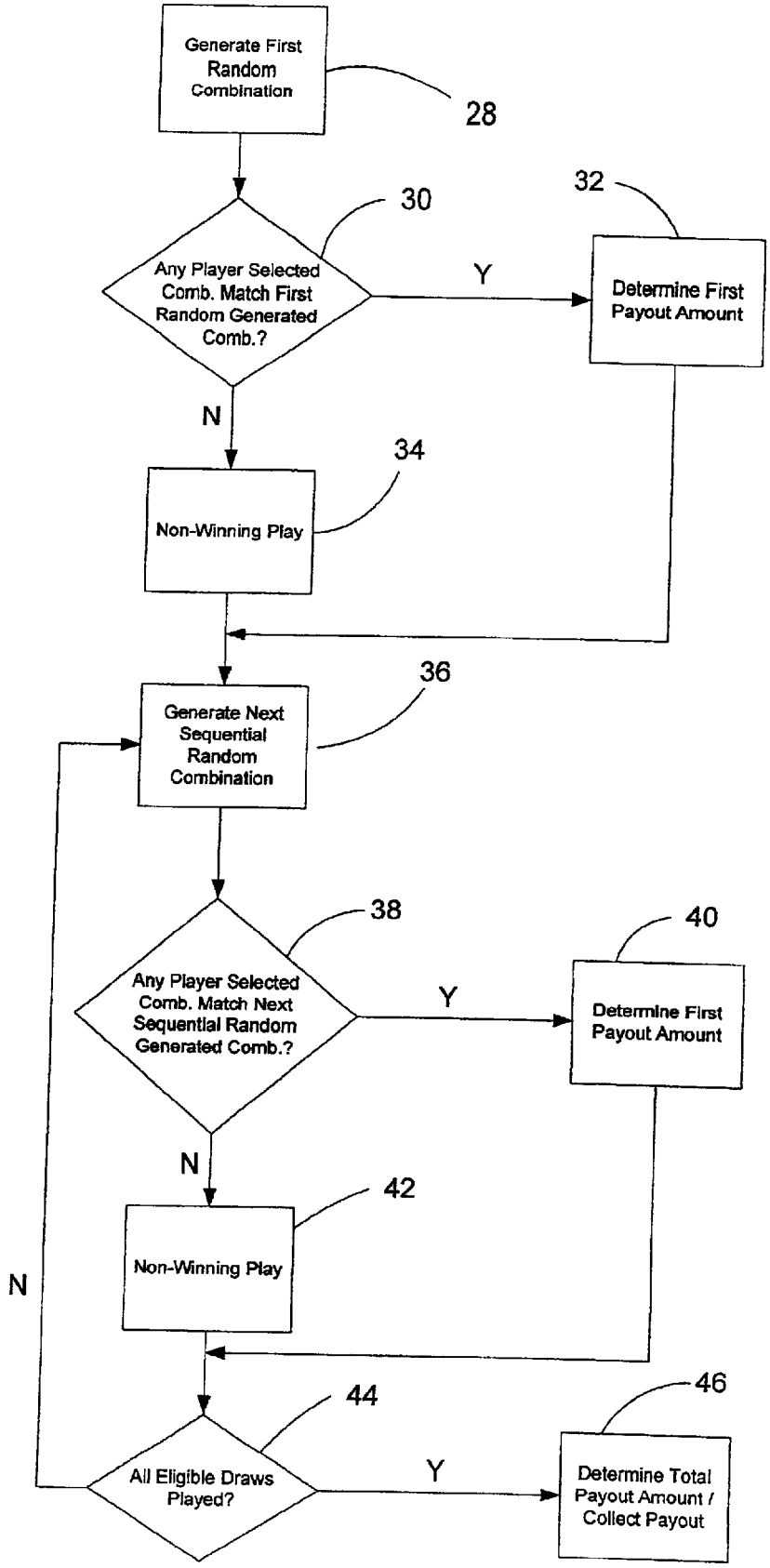
FIG. 7 is a flow diagram of a lottery-type game in accordance with an embodiment the present invention.

Once a player has obtained a wager ticket 48 from the gaming administrator, the player becomes eligible for the draws indicated thereon. The series of events which follows is illustrated in the flow diagram of FIG. 7. To begin play, a first random combination is generated by the gaming administrator as shown at 28. For instance, using the example from above, the gaming administrator may draw the numeral "3" from a first drum, the numeral "18" from a second drum and the numeral "21" from a third drum. The resulting gaming administrator generated combination is thus "3-18-21." The wager ticket 48 is then examined to determine whether any player-selected combinations match the first administrator generated combination as indicated at 30. A manual, mechanical or electronic display may be used at one or more locations to display the administrator generated indicia (and resulting combinations) so that the players can monitor the progress of the game and determine whether a particular draw results in a winning or non-winning outcome. For a player to achieve a winning outcome in the above example, the player-selected indicia 21 must include the numeral "3" in the first column 19A, the numeral "18" in the second column 19B, and the numeral "21" in the third column 19C. If the player-selected combination and the gaming administrator generated combination do match, a first payout amount is determined as shown at 32. If the player-selected combination and the gaming administrator generated combination do not match, the play is a non-winning play as indicated at 34.

The wager ticket 48 illustrated in FIG. 4 thus represents a winning ticket for the first draw as the numeral "3" was matched in the first column, the numeral "18" was matched in the second column, and the numeral "21" was matched in the third column. Referring to the exemplary payout table in FIG. 5, the payout amount may be determined. In the above example, the payout amount is $10.00 since three spots 18 were selected and this was the first win with the eligible wager ticket 48.

At this point in the game, the holder of eligible wager ticket 48 is still eligible for four additional draws. If wager ticket 48 is a winning ticket, the amount of the first payout either may be collected by the player or held by the gaming administrator until completion of the entire number of draws for which the wager ticket 48 is eligible have been played. In the case of the former option, the player may turn in his wager ticket 48, receive his winnings and the receive a trailer ticket for the remaining rounds of play for which the original wager ticket was eligible allowing the player continued participation.

However, the latter option of requiring a player to wait until completion of the entire number of draws may be desirable because, while the amount of the first payout is not forfeited even if none of the remaining draws are winning draws, if any of the remaining draws do, in fact, result in a winning play, the amount of the payout will increase. Accordingly, if the gaming administrator holds the payout amounts until the entire number of draws for which the wager ticket 48 is eligible have been played, the administrator will make only one payout per winning player rather than one payout for each winning draw. This will cut down on the administrative burden to the gaming administrator.

As indicated at 36, a next sequential random combination is generated by the gaming administrator. The wager ticket 48 then is examined to determine whether any player indicia matches the next sequential randomly generated combination as shown at 38. If any player-selected combination and the next sequential gaming administrator generated combination do match, a payout amount is determined based upon the number of draws the ticket 48 has won as indicated at 40. If there is not a match, the play is a non-winning play as shown at 42. If the play is a winning play, the payout amount determined is based upon the ticket 48 having won an additional eligible draw. Thus, the payout amount will be higher than that for having won only a single draw with the eligible ticket, the payout amount being an increased amount relative to the prior determined payout amount.

Referring again to the payout table illustrated in FIG. 5, the payout amount for a second winning play on a game play slip having three spots selected is $100.00. As the previous $10.00 payout amount was not forfeited, the effective prize amount for the second winning play is $90.00. This relationship is illustrated in the adjusted prize liability table of FIG. 6 which shows the payout amount for winning rounds of play if they are cashed out or collected by the player upon occurrence.

Thus, accounting of prize expense to the gaming administrator is relatively straightforward in the lottery-type game of the present invention. Although final prize amounts are not known until the final eligible draw, prizes may be booked to the appropriate draw as the draws occur. For instance, using the sample prize structure illustrated in FIG. 5, a four-spot ticket that wins three draws would win a total of $200.00. Of that $200.00 liability, $5.00 would have been won on the first draw, $15.00 on the second draw, and $180.00 on the third draw. Since prizes need not be forfeited in the lottery-type game of the present invention, prize expense can be recorded and allocated as it occurs according to the adjusted prize liability as shown in FIG. 6.

Additionally, it is noted that the prizes in the lottery-type game of the present invention are more than simply additive as compared to the individual purchase and play of multiple draws, but rather a nonlinearly increasing pay schedule is provided. In other words, achieving a winning outcome in two eligible draws on a single wager ticket 48 will net a higher prize amount than that achieved by two winning outcomes on two separate, more conventional lottery-type wager tickets. Thus, for example, with two spots played, a single win nets $50.00, a second win nets $1,000 and a third win nets $100,000. Thus the payout for the second win is more than twice as much as the payout for the first win. Likewise, the payout for the third win is more than twice as much as the payout for the second win.

Moreover, the payout amounts of the present invention are more proportionate to their odds of winning than in, for example, a traditional lottery. In other words, the prize structure is more balanced across the range of prizes regardless of the odds of winning each particular prize. Such is in contrast to traditional jackpot games wherein skewed prize structures are featured by moving a large portion of the prize fund into higher tier prizes, or more traditional instant games wherein the lower end of the prize structures are loaded.

At this point in the game, it must be determined whether or not all draws for which the wager ticket 48 is eligible have been played as indicated at 44. In the present example, the wager ticket 48 is eligible for five draws and only two have been played. Thus, the series of events in the flow chart of FIG. 7 continues with the generation of another sequential random combination by the gaming administrator as indicated at 36. The process is thus repeated, determining whether the wager ticket 48 is a winning ticket each time a random combination is generated by the gaming administrator, until all draws for which the ticket is eligible have been played. Once all eligible draws have been played, the player collects a payout amount based upon the number of eligible draws won as shown at 46.

Figure 8:
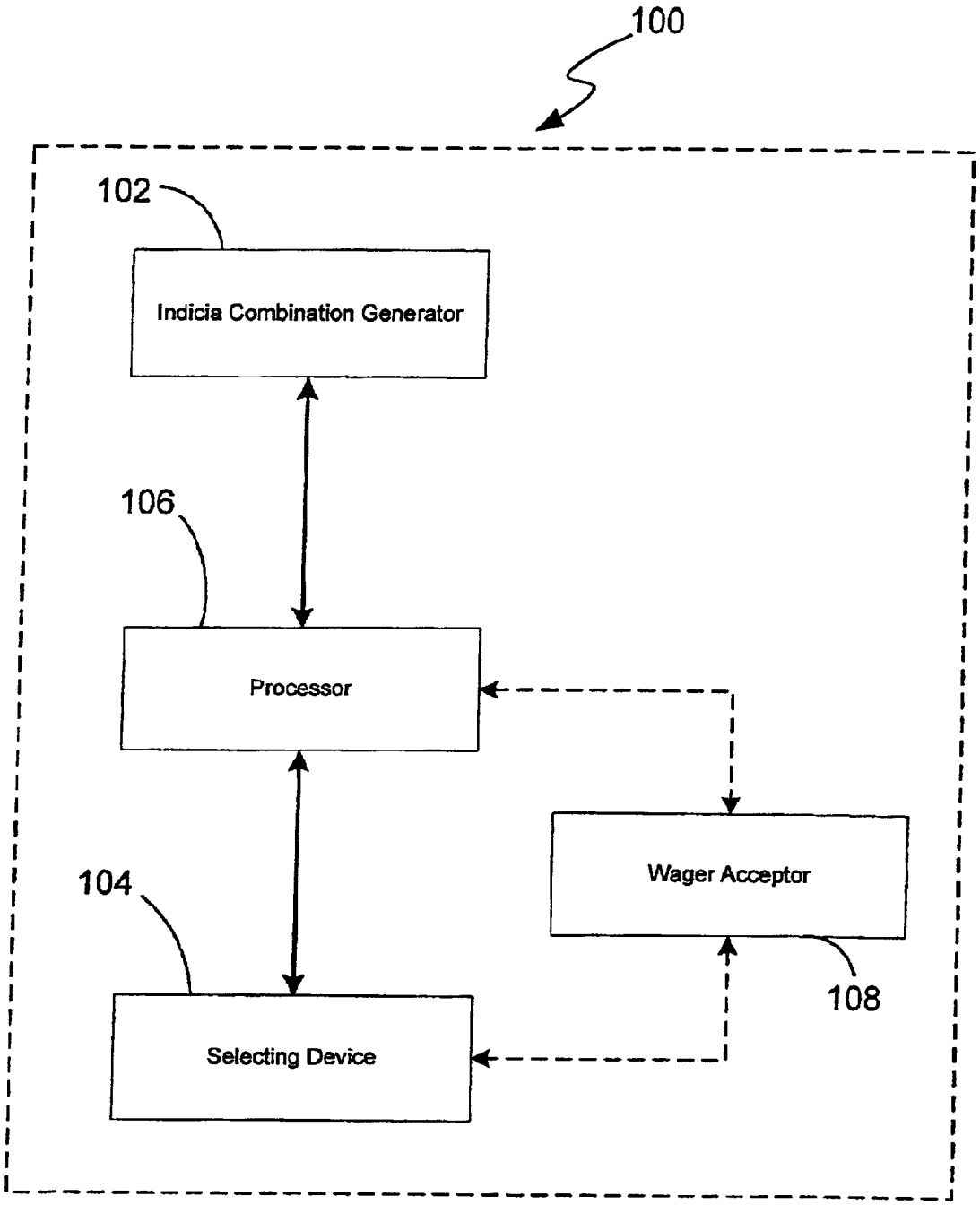
FIG. 8 is a schematic of a system for facilitating a lottery-type game according to an embodiment of the present invention.

Referring briefly now to FIG. 8, a schematic is shown of a system 100 which may be used to facilitate a lottery-type game according to an embodiment of the present invention. The system 100 includes an indicia combination generator 102 which, as set forth above may include any manual, mechanical or electrical device used by the gaming administrator to produce the series of randomly generated combinations of indicia. A selecting device 104 allows a player to enter the appropriate information in the various fields, such as selection of the player determining indicia field 12 and selection of particular spots 18 within a matrix 16 (FIGS. 1 and 2). Again, the selecting device may include any suitable manual, mechanical or electrical device as will be recognized by one of skill in the art. The selecting device 106 and the indicia combination generator may be coupled with a processor 106, such as, for example, a central processing unit. The processor may be used to compare the randomly generated combination of indicia from the indicia combination generator 102 to the player-selected indicia 21 (FIG. 2) set forth via the selecting device 106 to determine whether a match has occurred. If so desired, the processor 106 may also be used as a random number generator in place of, or in combination with, the indicia combination generator 102. Further, the processor may be used to collect and record the information provided by the selecting device 104.

A wager acceptor 108 may be coupled to the processor 106 and/or the selecting device, allowing a player's selections to become eligible for a predetermined quantity of draws. Thus, the system 100 may be configured such that the selecting device 104 is not operable until the wager acceptor 108 has validated a wager received thereby. Alternatively, the system 100 may be configured such that the processor does not validate a player's selections via the selecting device until an appropriate wager is received by the wager acceptor 108.

Thus as set forth herein, the present invention provides a game which allows players the opportunity to wager a small fixed sum and accumulate their winnings into substantial payout amounts. Further, the invention provides a lottery-type game which is fairly simple to operate, both for the gaming administrator and the player, which maintains user interest from the time of purchase through a series of draws, often days apart. Further still, depending upon how the game is played, the lottery-type game according to the present invention may represent different prizes for different players at the same time. For instance, on a given draw, one player may be on his fifth draw playing for $2,500.00 having already won two draws, while another player may be on his first draw, playing only to recover his wager. Moreover, a lottery-type game in accordance with the present invention allows players to cover many combinations with one minimum-sized bet and enjoy a potentially substantial payout amount.

Further, the lottery-type game of the present invention provides a game wherein a minimum wager amount per draw may be established wherein a number of draws are "bundled" for a predetermined quantity of draws. Thus, a minimum wager represented by the minimum wager amount per draw multiplied by the number of "bundled" draws may be required for eligibility. All eligible players may participate in each of the predetermined quantity of draws regardless of whether a winning outcome is achieved in any given single draw. Thus, players may be eligible to participate in all bundled draws even after a previous eligible draw results in a non-winning play.

The present invention thus provides a game of chance which permits players to wager a minimum initial bet for which they achieve eligibility for multiple draws without having to forfeit prizes already won in a previous draw. Further, the present invention provides a lottery-type game wherein a reduced number of decisions are required of players relative to other lottery-type games while still permitting the player the chance to win over a series of multiple draws. Still further, the present invention provides a system and method of playing a lottery-type game which provides players with a worthwhile value proposition which is consistent with player expectations (e.g., $5.00, 5 draws).

It is noted that while the above invention has been discussed largely in terms of a lottery-type game, the invention is not limited to such. Rather, the invention may be implemented in a plurality of forms, such as, for example, video gaming. A video-type game may allow a player to select or obtain a plurality of indicia to compare to a plurality of gaming administrator generated indicia in a more instantaneous type of play. For example, after selecting a number of indicia, a player could prompt the video-type gaming device to execute the draws or rounds of play at a pace chosen by the player. Thus, the plurality of rounds of play may be executed within minutes or seconds rather than days as suggested above with the above lottery-type game.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A method of playing a game of chance, the game being comprised of a series of individual rounds of play where in each round of play a win occurs if a player-selected combination of indicia matches a randomly generated combination of indicia, the method comprising the steps of:

establishing a quantity of player-selected combinations of indicia which may be obtained;

establishing a payout structure for the number of wins possible in the game;

obtaining at least one player-selected combination of indicia;

obtaining a player-selected number of rounds of play, wherein the player-selected number being at least two non-consecutive rounds; and for each individual round of play, obtaining a randomly generated combination of indicia;

determining whether the player-selected combination of indicia matches the randomly generated combination of indicia; and if the player-selected combination of indicia matches the randomly generated combination of indicia, issuing a payout amount and continuing to a next round of play.

2. The method according to claim 1, further comprising the step of allowing the player to stop the game and receive a payout for a total number of wins in the stopped game.

3. The method according to claim 1, further comprising providing a nonlinearly increasing payout structure for a plurality of winning rounds of play.

4. The method according to claim 1, further comprising establishing at least one payout amount which corresponds to both the quantity of player-selected combinations and a quantity of randomly generated combinations of indicia matched with the player-selected combination of indicia.

5. The method according to claim 1, wherein the step of obtaining at least one player-selected combination of indicia includes selecting a series of individual indicia from a set of indicia.

6. The method according to claim 5, wherein the step of obtaining a randomly generated combination of indicia includes randomly selecting a series of individual indicia from the set of indicia.

7. The method according to claim 5, wherein the set of indicia is organized in a plurality of columns of indicia.

8. The method according to claim 7, wherein the step of obtaining at least one player-selected combination of indicia includes obtaining a player selection of a specified quantity of indicia from each column of the plurality.

9. The method according to claim 8, wherein each of the at least one player-selected combination includes one indicium selected from each column of the plurality.

10. The method according to claim 8, wherein the step of obtaining a randomly generated combination of indicia comprises generating one indicium corresponding to each column of the plurality.

11. The method according to claim 1, wherein the step of establishing a payout structure includes in the payout amount according to a nonlinear increasing pay schedule.

12. A method of conducting a game of chance, the game comprising a series of individual rounds of play where in each round of play a win occurs if a player-selected combination of indicia matches a randomly generated combination of indicia; the method comprising the steps of:

a step for establishing a payout structure for a number of wins possible in the game;

a step for providing a plurality of player selectable indicia;

a step for allowing a player to select at least one combination of indicia from the plurality of player selectable indicia;

a step for allowing a player to select a number of rounds of play for the game, wherein the number being at least two con-consecutive rounds;

a step for randomly generating a combination of indicia from a set of indicia corresponding to the plurality of player selectable indicia for each round of play;

a step for determining whether the at least one player-selected combination of indicia matches the randomly generated combination of indicia for each individual round of play; and if the at least one player-selected combination of indicia matches the randomly generated combination of indicia, a step for issuing a payout amount and continuing to a next round of play.

13. The method according to claim 12, further comprising a step for allowing the player to stop the game and maintain a total number of wins for the stopped game.

14. The method according to claim 12, wherein the step for establishing payout amounts includes establishing a nonlinear increasing payout amount per additional win in a game.

15. The method according to claim 12, wherein the step for establishing a second payout amounts includes establishing an exponentially increasing payout amount per additional win in a game.

16. The method according to claim 12, further comprising a step for arranging the player selectable indicia in a matrix including a plurality of columns.

17. The method according to claim 16, wherein the step for allowing a player to select at least one combination of indicia from the plurality of player selectable indicia includes allowing the player to select a specified quantity of indicia from each column of the plurality of columns.

18. The method according to claim 17, further comprising a step for allowing the player to specify the quantity of indicia to be selected from each column of the plurality of columns.

19. A method of conducting a lottery game, comprising the steps of:

establishing a lottery game comprised of a plurality of individual rounds of play where in each round of play a win occurs if a player-selected combination of indicia matches a randomly generated combination of indicia;

requiring a player to become eligible for a plurality of rounds of play, wherein the plurality of rounds of play includes at least two non-consecutive rounds;

allowing the player to select a combination of indicia;

providing a nonlinear increasing payout schedule for multiple winning rounds of play within the plurality of rounds of play in which the player is eligible; and if the player-selected combination of indicia matches the randomly generated combination of indicia, issuing a payout amount to the player and continuing to a next round of play.

20. The method according to claim 19, wherein the step of requiring a player to become eligible for a plurality of rounds of play includes requiring the player to provide a total wager amount corresponding to a plurality of individual wager amounts, each individual wager amount corresponding to an individual round of play.

21. The method according to claim 19, wherein the step of providing a nonlinear increasing payout schedule includes each successive payout associated with a winning round of play is more than twice the previous payout.

22. The method according to claim 21, wherein the step of providing a nonlinear increasing payout schedule includes each successive payout associated with a winning round of play that is exponentially greater than the previous payout.

23. A system for facilitating a lottery game, comprising:

at least one indicia generator configured to generate a plurality of random combinations of indicia;

a set of player selectable indicia;

a device that generates a payout structure for a number of matches possible in the lottery game;

a selecting device configured to allow a player to obtain at least one player-selected combination of indicia from the set of player selectable indicia and to set a number of non-consecutive generation of a plurality of random combinations of indicia; and a processor configured to determine a number of matches between the at least one player-selected combination and the player-set quantity of the plurality of generated random combinations of indicia and determine a payout based upon the payout structure.

24. The system of claim 23, wherein the plurality of generated random combinations of indicia is drawn from a set of indicia corresponding to the set of player selectable indicia.

25. The system of claim 24, wherein the set of player selectable indicia is organized into a matrix including a plurality of columns of indicia.

26. The system of claim 25, wherein the selecting device is configured to allow a player to select a specified quantity of indicia from each column of the plurality.

27. The system of claim 26, wherein the selecting device is configured to allow a player to determine the specified quantity of indicia to select in each column of the plurality.

28. The system of claim 23, further comprising a wager collector configured to collect a wager amount corresponding to a specified quantity of sequentially generated combinations with which the at least one player-selected combination is eligible to be compared.

* * * * *